US010163409B2

(12) United States Patent
Lee et al.

(10) Patent No.: US 10,163,409 B2
(45) Date of Patent: Dec. 25, 2018

(54) DISPLAY DEVICE

(71) Applicant: Samsung Display Co., Ltd., Yongin-si, Gyeonggi-do (KR)

(72) Inventors: Kyoungwon Lee, Seoul (KR); Kwan-young Oh, Hwaseong-si (KR); Junghwan Cho, Asan-si (KR); Sangsu Han, Hanam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 14 days.

(21) Appl. No.: 15/090,447

(22) Filed: Apr. 4, 2016

(65) Prior Publication Data

US 2017/0061906 A1 Mar. 2, 2017

(30) Foreign Application Priority Data

Aug. 26, 2015 (KR) ..... 10-2015-0120418

(51) Int. Cl.
*G09G 3/36* (2006.01)

(52) U.S. Cl.
CPC ..... *G09G 3/3607* (2013.01); *G09G 3/3688* (2013.01); *G09G 2310/08* (2013.01);
(Continued)

(58) Field of Classification Search
CPC ..... G09G 3/3607; G09G 3/3688; G09G 2310/08; G09G 2320/0242; G09G 2320/0276
(Continued)

(56) References Cited

U.S. PATENT DOCUMENTS 5,828,357 A * 10/1998 Tamai ..... G09G 3/2011 345/210
2004/0246224 A1* 12/2004 Tsai ..... G09G 3/3611 345/100

(Continued)

FOREIGN PATENT DOCUMENTS

KR 10-1330353 B1 11/2013
KR 10-2015-0082816 A 7/2015

OTHER PUBLICATIONS

Tsuruma et al., "Novel Image Sticking Model in the Fringe Field Switching Mode Based on the Flexoelectric Effect", 2011, 4 pages, LTPS Engineering Division, Sony Mobile Display Corporation, Japan and Display Device Business Division, Sony Corporation.

*Primary Examiner* — Kent Chang
*Assistant Examiner* — Mark Edwards
(74) *Attorney, Agent, or Firm* — Lewis Roca Rothgerber Christie LLP

(57) ABSTRACT

A display device includes a display panel including a plurality of pixels respectively connected to a plurality of gate lines and to a plurality of data lines, a gate driving circuit configured to drive the plurality of gate lines, a data driving circuit configured to drive the plurality of data lines, a timing controller configured to provide a data signal to the data driving circuit, configured to control the gate driving circuit, and configured to output a voltage control signal, and a voltage generator configured to generate a plurality of reference voltages in response to the voltage control signal, wherein the data driving circuit is further configured to convert the data signal into a grayscale voltage based on the plurality of reference voltages, wherein a voltage level of each of the reference voltages is changed periodically within a range.

11 Claims, 12 Drawing Sheets

(52) U.S. Cl.
CPC ..... *G09G 2320/0242* (2013.01); *G09G 2320/0276* (2013.01)

(58) Field of Classification Search
USPC ..... 345/690
See application file for complete search history.

(56) References Cited

U.S. PATENT DOCUMENTS

| | | | | |
|---|---|---|---|---|
| 2010/0033413 | A1* | 2/2010 | Song | G09G 3/3655 345/89 |
| 2013/0249969 | A1* | 9/2013 | Jeon | G09G 5/10 345/691 |
| 2014/0085345 | A1* | 3/2014 | Ma | G09G 3/3614 345/690 |
| 2015/0206473 | A1* | 7/2015 | Ahn | G09G 3/2055 345/596 |

* cited by examiner

DISPLAY DEVICE

CROSS-REFERENCE TO RELATED APPLICATION

This application claims priority to, and the benefit of, Korean Patent Application No. 10-2015-0120418, filed on Aug. 26, 2015, the entire content of which is incorporated herein by reference.

BACKGROUND

1. Field

The present disclosure herein relates to a display device.

2. Description of the Related Art

A liquid crystal display device, which is one type of a display device, is widely used in fields, such as notebook monitors and TVs, due to its excellent video quality and high contrast ratio. A liquid crystal driving method may include Twisted Nematic (TN), In-plane switching (IPS), Fringe Filed Switching (FFS), and so on. A transverse electric field driving method, such as IPS and FFS, operates by forming an electric field in a direction parallel to a substrate to thereby display an image by rotating liquid crystal molecules having dipole moments within a plane that is parallel to the substrate. When voltage is applied to each pixel electrode and to a common electrode, the transverse electric field driving method forms an electric field in a direction parallel to the substrate. When liquid crystal molecules are oriented in an electric field direction when the voltage is applied, orientation deformation may occur, such as a so-called splay deformation or bend deformation. Such orientation deformation causes image quality deterioration due to a phenomenon known as flexoelectric effect.

SUMMARY

One or more aspects of embodiments of the present disclosure provide a display device for improving display quality.

According to an embodiment of the inventive concept, a display device includes a display panel including a plurality of pixels respectively connected to a plurality of gate lines and to a plurality of data lines, a gate driving circuit configured to drive the plurality of gate lines, a data driving circuit configured to drive the plurality of data lines, a timing controller configured to provide a data signal to the data driving circuit, configured to control the gate driving circuit, and configured to output a voltage control signal, and a voltage generator configured to generate a plurality of reference voltages in response to the voltage control signal, wherein the data driving circuit is further configured to convert the data signal into a grayscale voltage based on the plurality of reference voltages, wherein a voltage level of each of the reference voltages is changed periodically within a range.

The data driving circuit may include a gamma voltage generator configured to generate a plurality of gamma voltages based on the plurality of reference voltages, and a data driver configured to select a gamma voltage of the plurality of gamma voltages corresponding to the data signal as the grayscale voltage, and configured to drive the plurality of data lines by using the grayscale voltage.

The plurality of reference voltages may include first and second reference voltages having a voltage level that is higher than a common voltage, and third and fourth reference voltages having a voltage level that is lower than the common voltage.

The gamma voltage generator may include a positive reference voltage generation unit configured to generate a plurality of positive reference voltages based on the first and second reference voltages, and a positive gamma voltage generation unit configured to generate a plurality of positive gamma voltages based on the plurality of positive reference voltages.

The gamma voltage generator may include a negative reference voltage generation unit configured to generate a plurality of negative reference voltages based on the third and fourth reference voltages, and a negative gamma voltage generation unit configured to generate a plurality of negative gamma voltages based on the plurality of negative reference voltages.

The voltage control signal may include information corresponding to an upper voltage level and a lower voltage level for each of the reference voltages.

Each of the reference voltages may be changed stepwise into a plurality of voltage levels between the upper voltage level and the lower voltage level.

The voltage control signal may include information corresponding to a change period of each of the reference voltages.

The change period may be less than about 1 second.

A voltage level of each of the plurality of reference voltages may be at a constant voltage level, and the timing controller may be further configured to receive an image signal, to convert the image signal into the data signal that is changed periodically within a range, and to provide the data signal to the data driving circuit.

The timing controller may include a gamma adjustment unit configured to adjust a gamma level of the image signal, and configured to output a gamma data signal, and a dithering unit configured to dither the gamma data signal to output the data signal.

The gamma data signal may swing periodically within a range based on the image signal.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
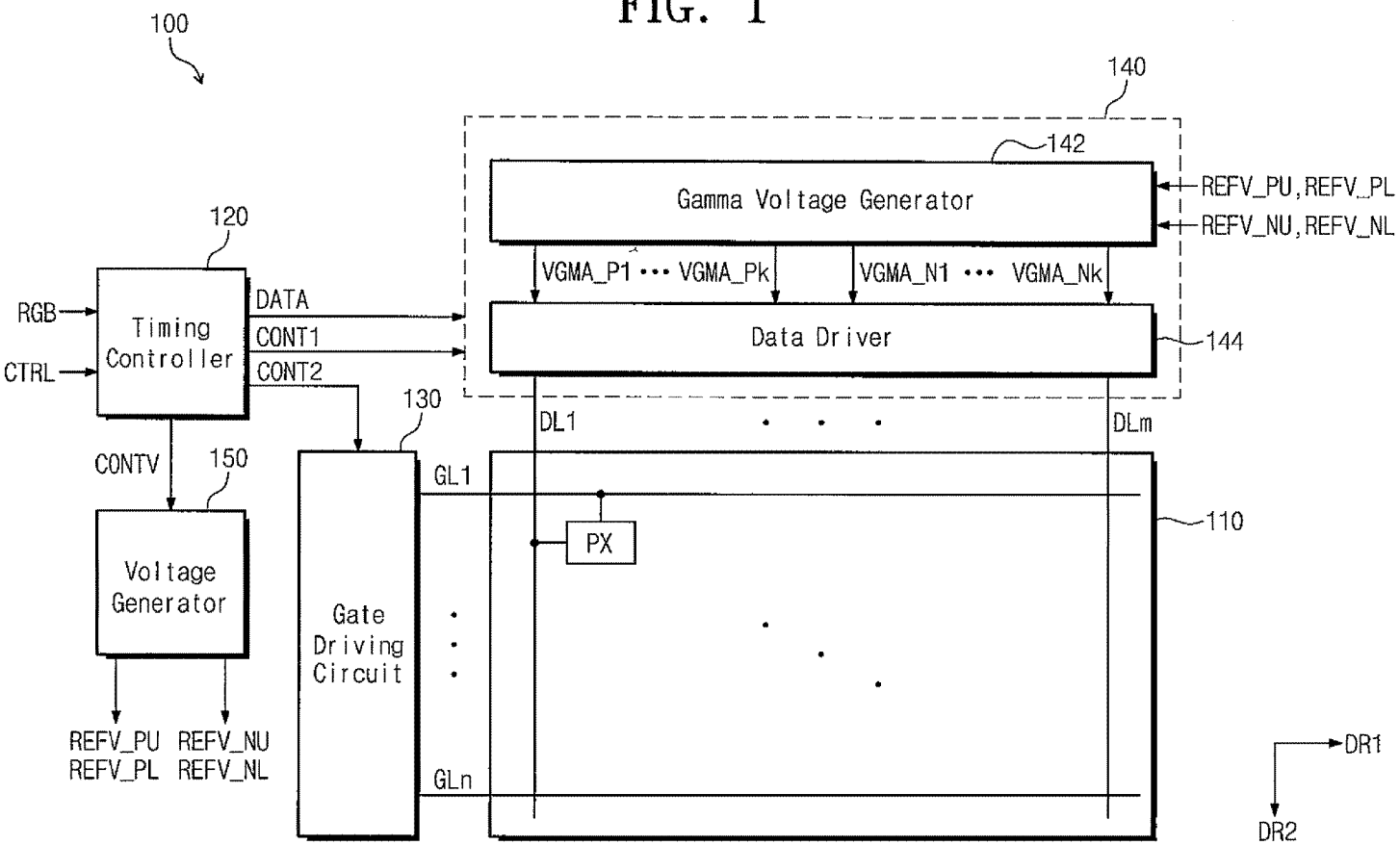
FIG. 1 is a block diagram illustrating a display device according to an embodiment of the inventive concept.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to an embodiment of the inventive concept.

Referring to FIG. 1, a display device 100 includes a display panel 110, a timing controller 120, a gate driving circuit 130, a data driving circuit 140, and a voltage generator 150. In this embodiment, the display panel 110 may be configured with a liquid crystal display panel. The display device 100 may further include a polarizer and a backlight unit.

The display panel 110 includes a plurality of gate lines GL1 to GLn extending in a first direction DR1, a plurality of data lines DL1 to DLm crossing the plurality of gate lines GL1 to GLn and extending in a second direction DR2, and a plurality of pixels PX arranged in a matrix at respective crossing regions of the data lines DL1 to DLm and the gate lines GL1 to GLn. The plurality of gate lines GL1 to GLn and the plurality of data lines DL1 to DLm are insulated from each other.

The timing controller 120 may receive externally supplied image signal RGB, and may receive control signals CTRL for controlling the displayed images, the control signals CTRL including, for example, vertical sync signals, horizontal sync signals, main clock signals, and data enable signals. The timing controller 120 provides, to the data driving circuit 140, a data signal DATA, which is obtained by processing an image signal RGB to correspond to an operating condition of the display panel 110 based on control signals CTRL, and a first control signal CONT1. The timing controller 120 also provides a second control signal CONT2 to the gate driving circuit 130. The first control signal CONT1 may include a clock signal and a line latch signal, and the second control signal CONT2 may include a vertical sync start signal, an output enable signal, and a gate pulse signal. The timing controller 120 may provide a voltage control signal CONTV to the voltage generator 150.

The gate driving circuit 130 drives the gate lines GL1 to GLn in response to the second control signal CONT2 from the timing controller 120. The gate driving circuit 130 may include a gate driving integrated circuit (IC). The gate driving circuit 130 is not limited to a gate driving IC, and may be implemented with a circuit using an oxide semiconductor, an amorphous semiconductor, a crystalline semiconductor, and a polycrystalline semiconductor.

The voltage generator 150 generates first to fourth reference voltages REFV_PU, REFV_PL, REFV_NU, and REFV_NL in response to the voltage control signal CONTV from the timing controller 120. The voltage generator 150 may further generate various voltages for operations of the display device 100 in addition to the first to fourth reference voltages REFV_PU, REFV_PL, REFV_NU, and REFV_NL.

The data driving circuit 140 includes a gamma voltage generator 142 and a data driver 144. The data driving circuit 140 including the gamma voltage generator 142 and the data driver 144 driving circuit 140 may be implemented as a single IC. The gamma voltage generator 142 generates a plurality of gamma voltages VGMA_P1 to VGMA_Pk, and VGMA_N1 to VGMA_Nk, based on the first to fourth reference voltages REFV_PU, REFV_PL, REFV_NU, and REFV_NL from the voltage generator 150.

The data driver 144 drives the data lines DL1 to DLm by using the plurality of gamma voltages VGMA_P1 to VGMA_Pk and VGMA_N1 to VGMA_Nk in response to the data signal DATA and the first control signal CONT1 from the timing controller 120. The data driver 144 may be implemented as an IC. The data driver 144 implemented as an IC may be mounted on a tape carrier package (TCP) or by a chip on film (COF) method to be electrically connected to the display panel 110. In another embodiment, the data driver 144 may be directly mounted on the display panel 110.

Figure 2:
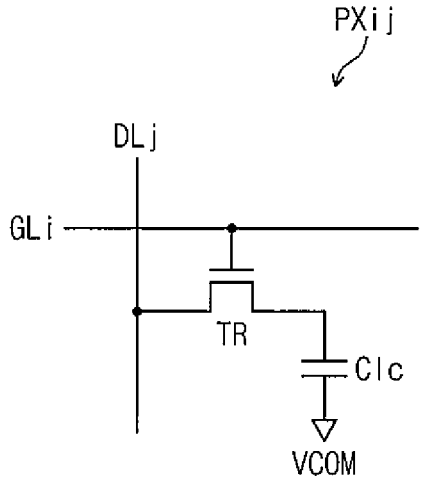
FIG. 2 is an equivalent circuit diagram of a pixel shown in FIG. 1.
Figure 3:
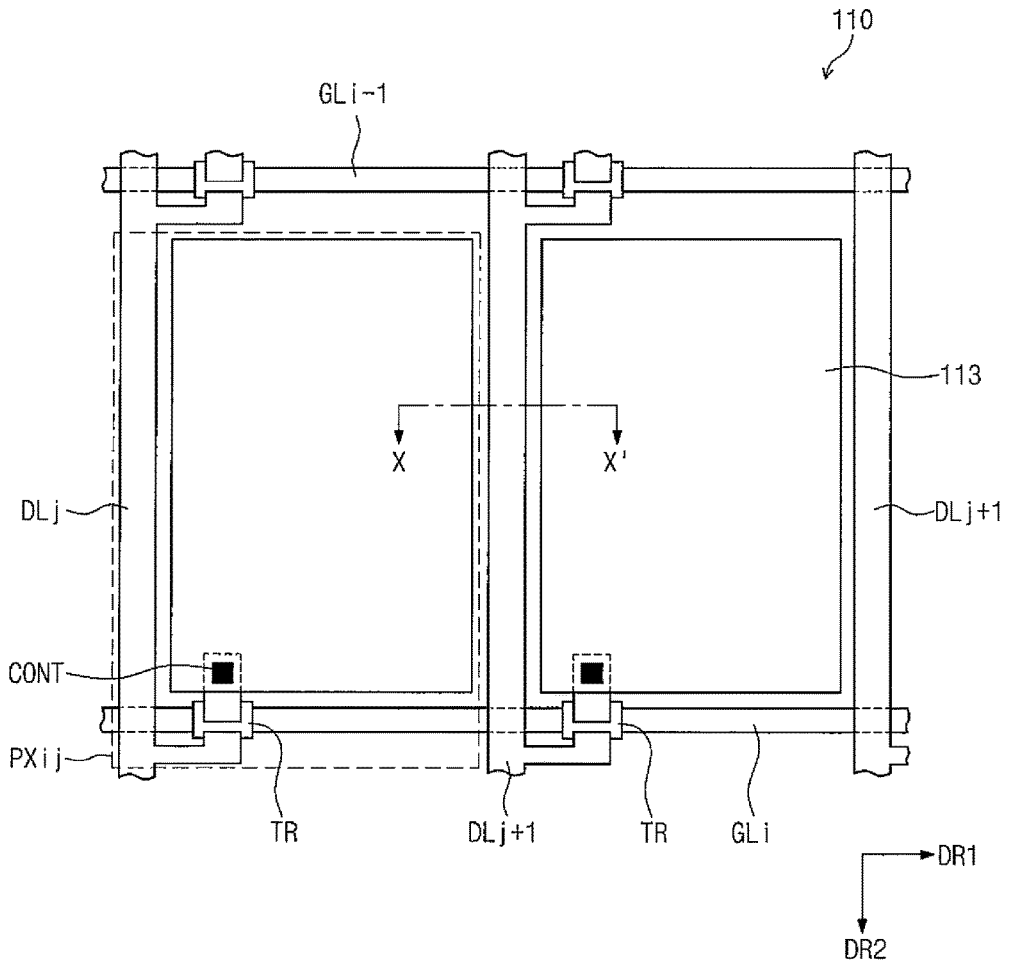
FIG. 3 is a plan view of a pixel shown in FIG. 1.

FIG. 2 is an equivalent circuit diagram of a pixel shown in FIG. 1, and FIG. 3 is a plan view of a pixel shown in FIG. 1.

Referring to FIG. 2, an i×jth pixel PXij includes a pixel transistor TR and a liquid crystal capacitor Clc. Hereinafter, in the specification, a transistor refers to a thin film transistor. Accordingly, the pixel PXij may further include a storage capacitor.

As shown in FIGS. 2 and 3, the pixel transistor TR is electrically connected to an ith gate line GLi and to a jth data line DLj. The pixel transistor TR delivers, to the liquid crystal capacitor Clc, a pixel voltage corresponding to a data signal received from the jth data line DLj in response to a gate signal received from the ith gate line GLi.

One end of the liquid crystal capacitor Clc is connected to the pixel transistor TR, and the other end of the liquid crystal capacitor Clc is connected to a common voltage VCOM. The common voltage VCOM may be generated by the voltage generator 150 shown in FIG. 1. The liquid crystal capacitor Clc charges a pixel voltage output from the pixel transistor TR. An arrangement of liquid crystal molecules included in a liquid crystal layer is changed according to a charge amount charged in the liquid crystal capacitor Clc. The transmittance of light incident to a liquid crystal layer is adjusted according to an arrangement of liquid crystal molecules.

As shown in FIGS. 2 and 3, the pixel transistor TR and the pixel electrode 113 contact each other through a contact (e.g., a contact hole) CONT. A common electrode 111 (see FIG. 4) is formed over the entire layer below the pixel electrode 113, and may provide the common voltage VCOM to the liquid crystal capacitor Clc. The pixel electrode 113 and the common electrode 111 may be configured as a transparent electrode, such as an Indium Tin Oxide (ITO) electrode.

Figure 4:
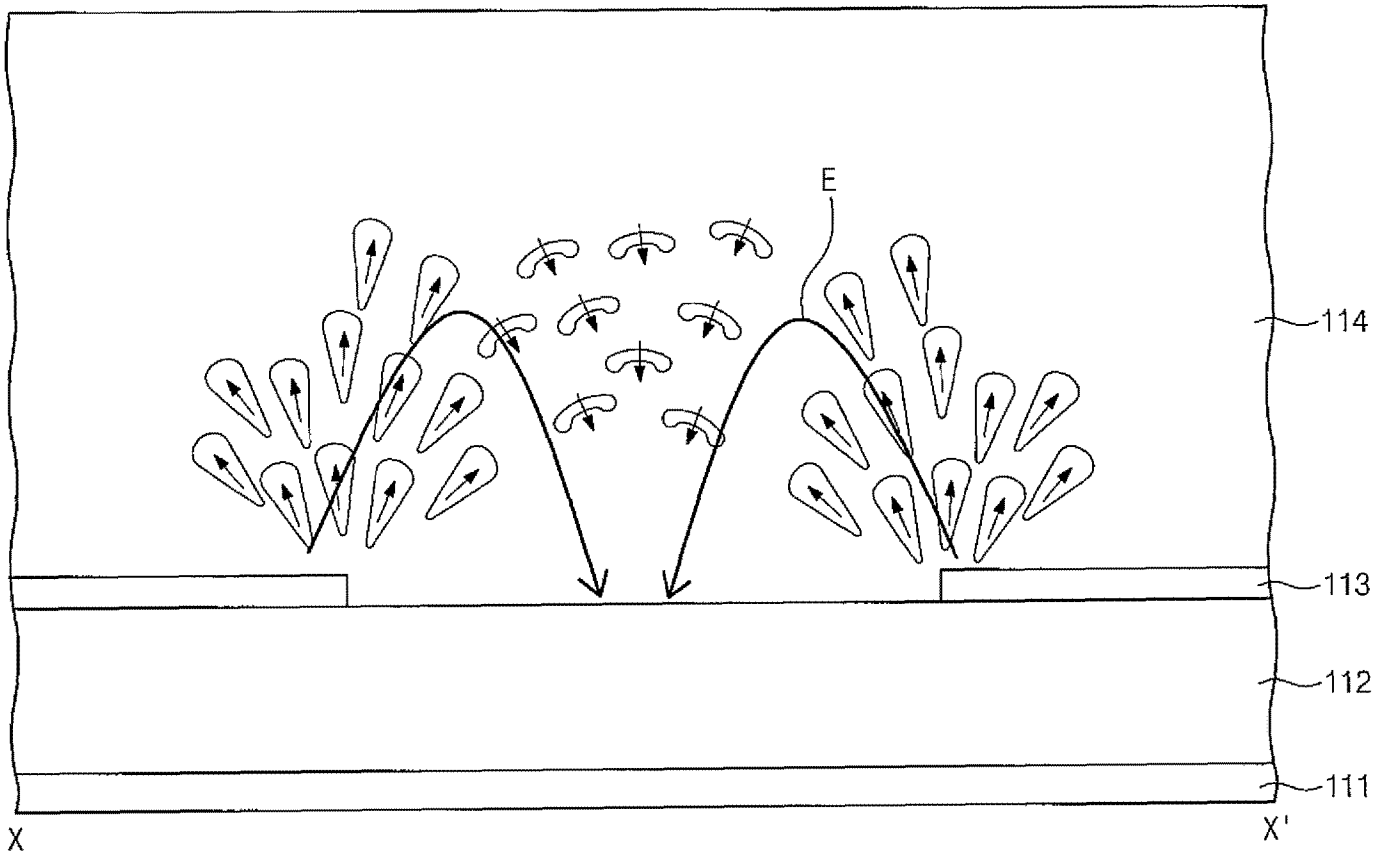
FIG. 4 is a cross sectional view illustrating a flexoelectric phenomenon along the line X to X' shown in FIG. 3.

FIG. 4 is a cross sectional view illustrating a flexoelectric phenomenon taken along the line X to X' shown in FIG. 3.

Referring to FIGS. 3 and 4, a display panel 110 includes the common electrode 111, an insulation layer 112, the pixel electrode 113, and a liquid crystal layer 114.

The flexoelectric phenomenon refers to a phenomenon in which the macroscopic polarization is generated by the orientation deformation of liquid crystal. When a voltage is applied across the common electrode 111 and the pixel electrode 113, an electric field E is formed. By the direction of the electric field E, a bending polarization occurs between adjacent pixel electrodes 113, and a splay polarization occurs at an edge portion of the pixel electrode 113.

On the other hand, the display device 100 may employ an AC driving (or frame inversion driving) method to prevent deterioration of liquid crystal. In the AC driving method, the polarity of the potential difference between a voltage of the pixel electrode 113 and a voltage of the common electrode 113 is reversed periodically.

Especially, due to the flexoelectric phenomenon, the polarization direction of liquid crystal corresponds to the direction of the electric field E during positive driving, in which a voltage provided to the common electrode 111 is higher than a voltage provided to the pixel electrode 113. Accordingly, during negative driving, in which a voltage provided to the common electrode 111 is lower than a voltage provided to the pixel electrode 113, the intensity of the electric field E affecting the liquid crystal becomes weak. That is, even if positive driving voltage and negative driving voltage provided to the pixel electrode 113 have the same absolute value, there is a difference between the two with respect to the light transmission through the liquid crystal.

If the size of a splay polarization induced by the flexoelectric phenomenon is increased, residual DC voltage is accumulated at an edge area of the pixel electrode 113. That is, even when voltage is not applied to the pixel electrode 113 and the common electrode 111, the same effect occurs as if a voltage was applied. When a voltage is applied to the pixel electrode 113 and the common electrode 111, the voltage serves as bias voltage. Due to such a residual DC voltage, the brightness of a positive frame and the brightness of a negative frame become different, which may cause an image to be flashing. As a result, display quality is deteriorated.

Figure 5:
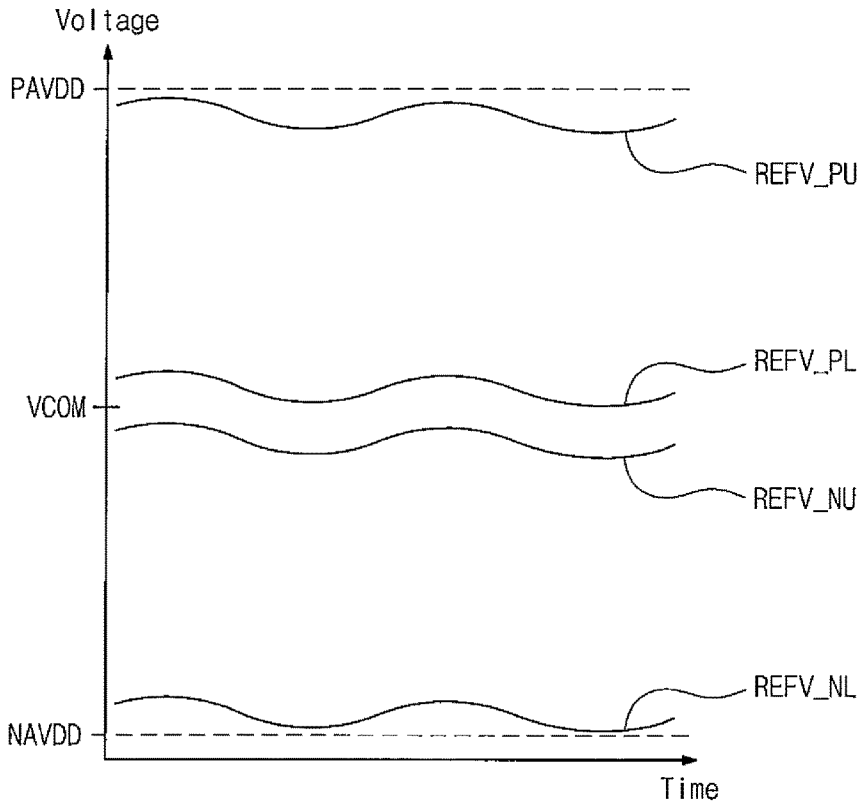
FIG. 5 is a view illustrating first to fourth reference voltages generated by a voltage generator shown in FIG. 1.

FIG. 5 is a view illustrating first to fourth reference voltages generated by the voltage generator shown in FIG. 1.

Referring to FIG. 5, a first reference voltage REFV_PU and a second reference voltage REFV_PL are positive reference voltages that are higher than a common voltage VCOM and lower than the maximum positive voltage PAVDD. A third reference voltage REFV_NU and a fourth reference voltage REFV_NL are negative reference voltages that are lower than a common voltage VCOM and higher than the minimum negative voltage NAVDD.

The first to fourth reference voltages REFV_PU, REFV_PL, REFV_NU, and REFV_NL are changed within a given period. A change period of the first to fourth reference voltages REFV_PU, REFV_PL, REFV_NU, and REFV_NL may be set (for example, to have a frequency that is greater than about 1 Hz) to be not recognizable by a person (e.g., not perceivable by the human eye).

Figure 6:
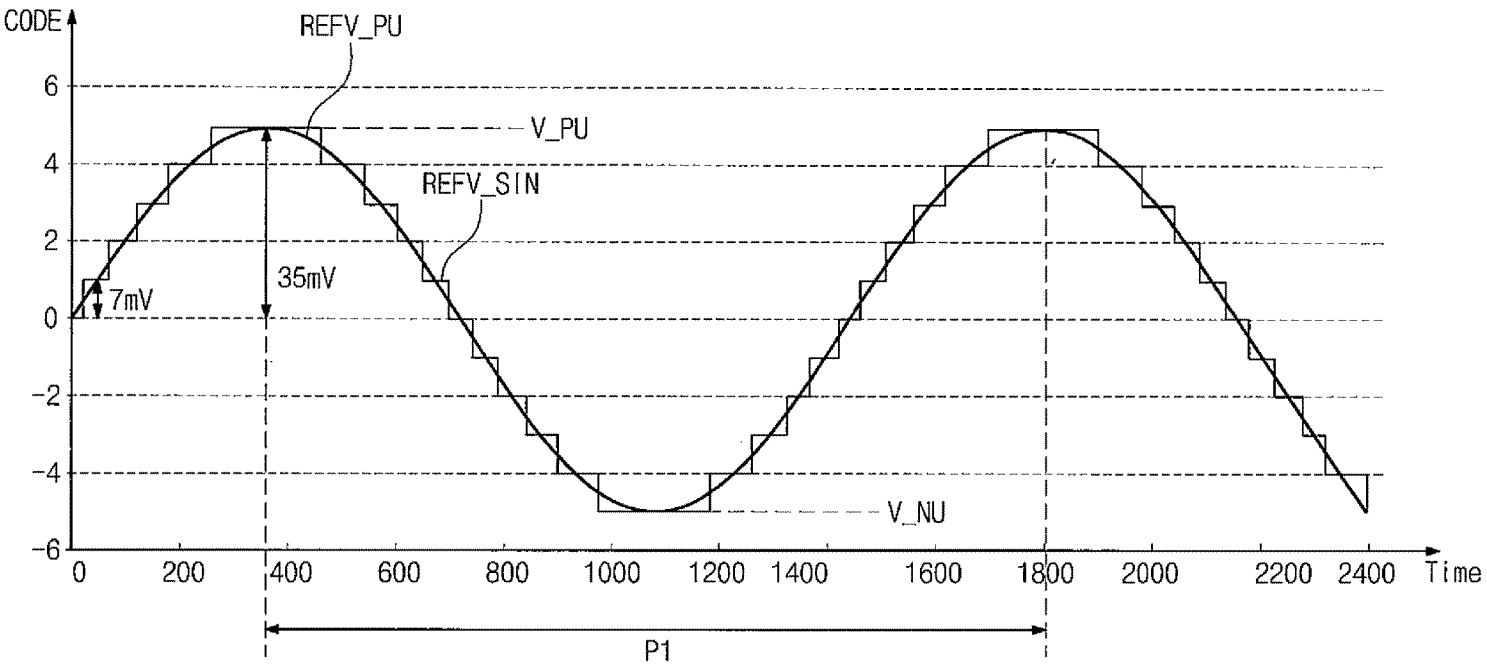
FIG. 6 is a view illustrating a voltage level change of a first reference voltage generated from a voltage generator shown in FIG. 1.

FIG. 6 is a view illustrating a voltage level change of a first reference voltage generated from a voltage generator shown in FIG. 1.

Referring to FIGS. 1 and 6, the voltage generator 150 generates a first reference voltage REFV_PU in response to the voltage control signal CONTV provided from the timing controller 120. The voltage control signal CONTV provided from the timing controller 120 may include a code signal CODE corresponding to a voltage level of the first reference voltage REFV_PU. The code signal CODE is a digital signal that is changed in a stepwise manner according to a sine waveform REFV_SIN that swings between an upper voltage level V_PU and a lower voltage level V_NU. The voltage generator 150 may generate the first reference voltage REFV_PU having a voltage level corresponding to the code signal CODE included in the voltage control signal CONTV.

In another embodiment, the voltage control signal CONTV provided from the timing controller 120 may include information on an upper voltage level V_PU, a lower voltage level V_NU, and a change period P1. The voltage generator 150 may generate the first reference voltage REFV_PU that is changed in a stepwise manner at each predetermined time in response to the upper voltage level V_PU and the lower voltage level V_NU included in the voltage control signal CONTV. In the example shown in FIG. 6, a difference between the upper voltage level V_PU and the lower voltage level V_NU may be about 70 mV, and each step specific voltage difference may be about 7 mV. Additionally, the change period P1 may correspond to a frequency of about 1 Hz (e.g., may be about 1 second).

Although only a voltage level change of the first reference voltage REFV_PU is shown in FIG. 6, the second to fourth reference voltages REFV_PL, REFV_NU, and REFV_NL are generated in a similar method to the method of generating the first reference voltage REFV_PU.

Figure 7:
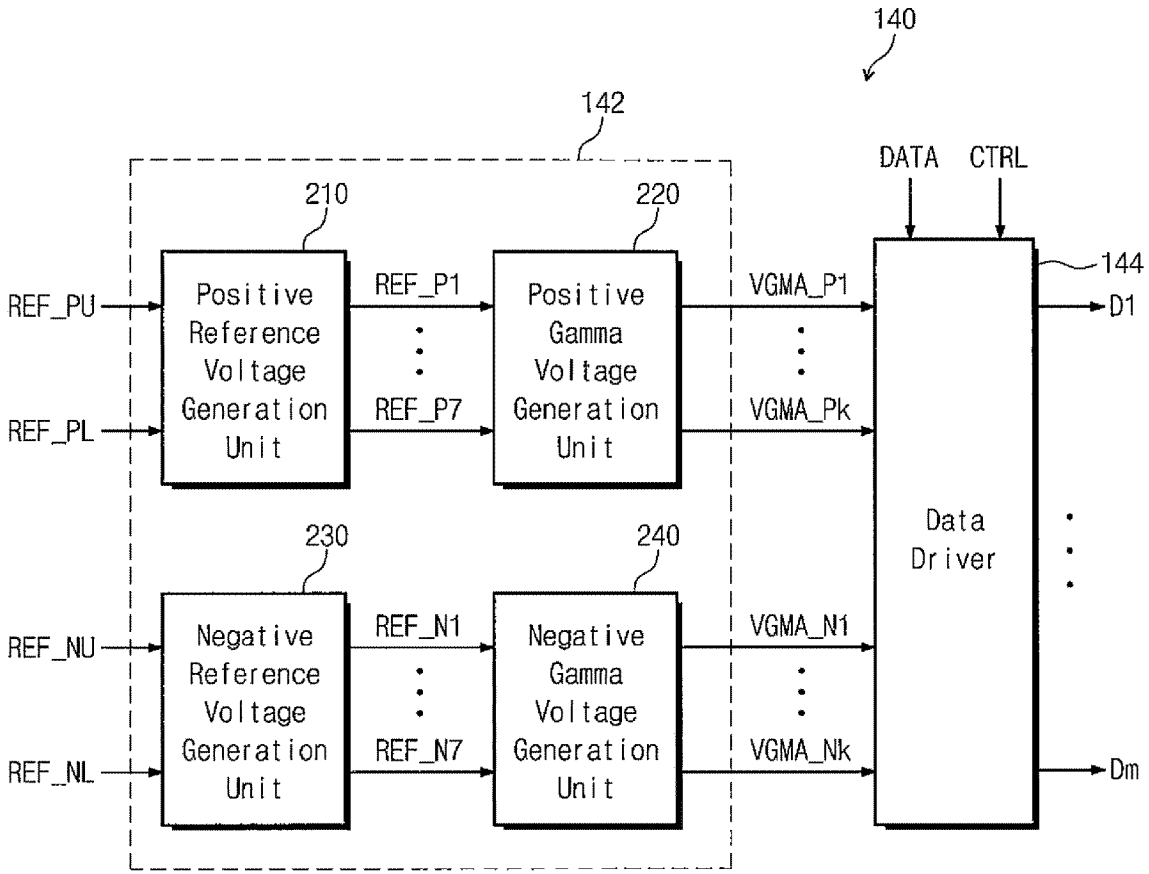
FIG. 7 is a block diagram illustrating a configuration of a data driving circuit shown in FIG. 1.

FIG. 7 is a block diagram illustrating a configuration of the data driving circuit shown in FIG. 1.

Referring to FIG. 7, the data driving circuit 140 includes a gamma voltage generator 142 and a data driver 144. The gamma voltage generator 142 includes a positive reference voltage generation unit 210, a positive gamma voltage generation unit 220, a negative reference voltage generation unit 230, and a negative gamma voltage generation unit 240.

The positive reference voltage generation unit 210 receives a first reference voltage REF_PU and a second reference voltage REF_PL, and generates positive reference voltages REF_P1 to REF_P7. The positive reference voltage generation unit 210 may include a plurality of divider registers between the first reference voltage REF_PU and the second reference voltage REF_PL. The positive reference voltage generation unit 210 may output voltages of connection nodes between respective ones of the divider registers as the positive reference voltages REF_P1 to REF_P7. The positive reference voltage generation unit 210 receives the positive reference voltages REF_P1 to REF_P7, and generates a plurality of positive gamma voltages VGMA_P1 to VGMA_Pk.

The negative reference voltage generation unit 230 receives a third reference voltage REF_NU and a fourth reference voltage REF_NL, and generates negative reference voltages REF_N1 to REF_N7. The negative reference voltage generation unit 230 may include a plurality of divider registers between the third reference voltage REF_NU and the fourth reference voltage REF_NL. The negative reference voltage generation unit 230 may output voltages of connection nodes between respective ones of the divider registers as the negative reference voltages REF_N1 to REF_N7. The negative reference voltage generation unit 240 receives the negative reference voltages REF_N1 to REF_N7, and generates a plurality of negative gamma voltages VGMA_N1 to VGMA_Nk.

The data driver 144 outputs data signals D1 to Dm for respectively driving the data lines DL1 to DLm by using the plurality of positive gamma voltages VGMA_P1 to VGMA_Pk and the plurality of negative gamma voltages VGMA_N1 to VGMA_Nk in response to the data signal DATA and the first control signal CONT1 from the timing controller 120.

Figure 8:
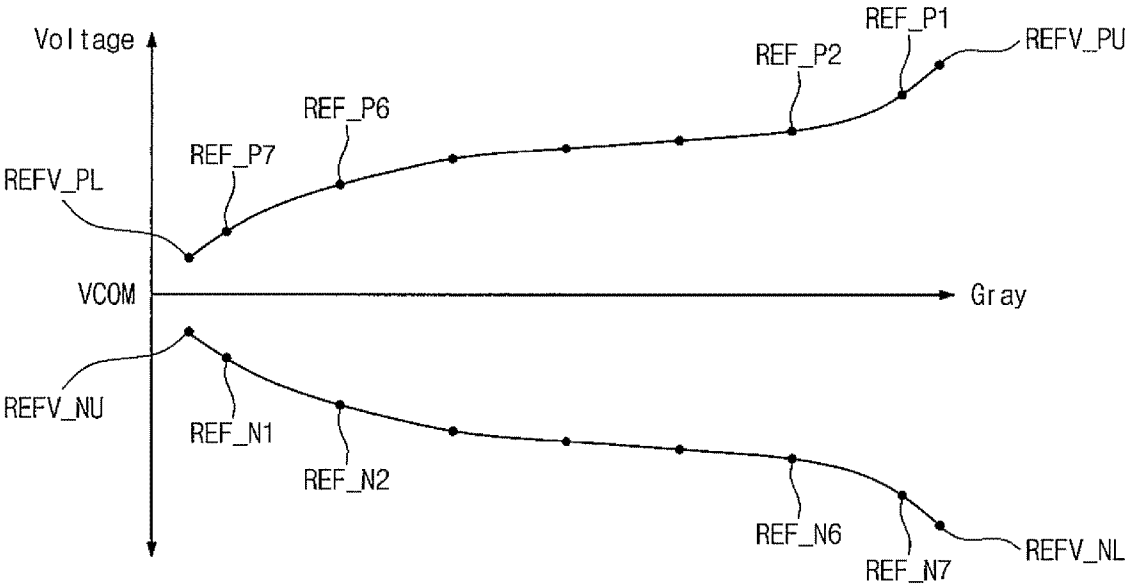
FIG. 8 is a view illustrating positive reference voltages and negative reference voltages generated from a positive reference voltage generation unit and a negative reference voltage generation unit shown in FIG. 7.

FIG. 8 is a view illustrating positive reference voltages and negative reference voltages generated from the positive reference voltage generation unit and the negative reference voltage generation unit shown in FIG. 7.

Referring to FIGS. 7 and 8, the positive reference voltage generation unit 210 generates positive reference voltages REF_P1 to REF_P7 that have a lower level than the first reference voltage REF_PU, and that have a higher level than the second reference voltage REF_PL, but that have different voltage levels.

As described with reference to FIG. 5, a voltage level of the first reference voltage REF_PU and the second reference voltage REF_PL is changed periodically. As a voltage level of the first reference voltage REF_PU and the second reference voltage REF_PL is changed, a voltage level of the positive reference voltages REF_ P1 to REF_ P7 may be changed periodically. In the same manner, as a voltage level of the third reference voltage REF_NU and the fourth reference voltage REF_NL is changed, a voltage level of the negative reference voltages REF_N1 to REF_N7 may be changed periodically.

As a result, as the first to fourth reference voltages REF_PU, REF_PL, REF_ NU, and REF_NL are changed periodically, the positive gamma voltages VGMA_P1 to VGMA_Pk and the negative gamma voltages VGMA_N1 to VGMA_Nk may be changed periodically.

Figure 9:
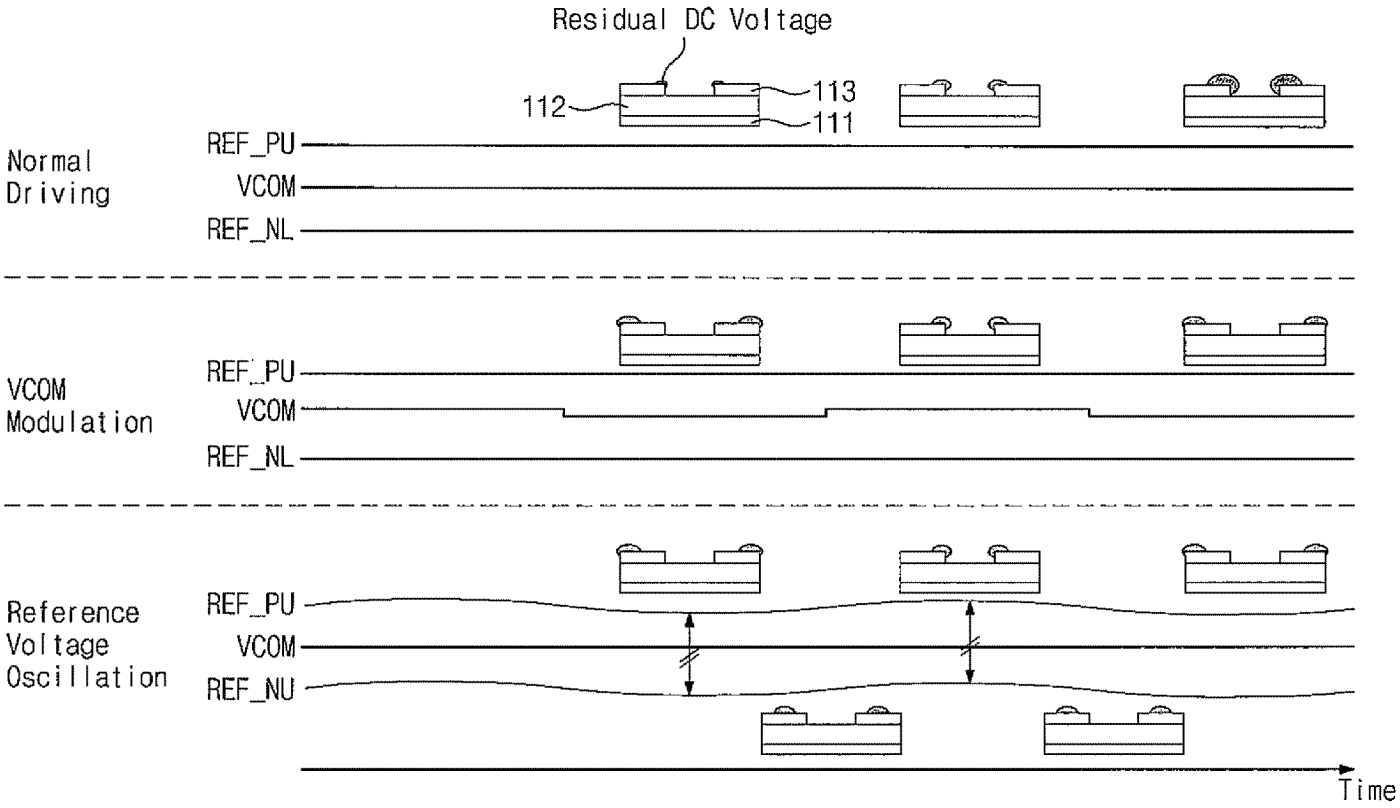
FIG. 9 is a view illustrating a change of a residual DC voltage according to a voltage level of a first reference voltage and a fourth reference voltage.

FIG. 9 is a view illustrating a change of a residual DC voltage according to a voltage level of a first reference voltage and a fourth reference voltage.

Referring to FIG. 9, during a normal driving mode (Normal Driving) in which a voltage level of a first reference voltage REF_PU, a fourth reference voltage REF_NL, and a common voltage VCOM is fixed, a residual DC voltage is accumulated at an edge portion of the pixel electrode 111.

During a VCOM Modulation mode, when voltage levels of the first reference voltage REF_PU and the fourth reference voltage REF_NL are fixed, and when a voltage level of the common voltage VCOM is changed periodically between a first level VCOM1 and a second level VCOM2, a residual DC voltage is alternately accumulated at a positive side edge portion of the pixel electrode 111.

According to an embodiment of the inventive concept, during a Reference Voltage Oscillation mode, when a voltage level of the common voltage VCOM is fixed, and when voltage levels of the first reference voltage REF_PU and the fourth reference voltage REF_NL are respectively changed periodically, a residual DC voltage is uniformly distributed and accumulated at the front surface of the pixel electrode 111. In such a manner, as a residual DC voltage is distributed at the front surface of the pixel electrode 111, a brightness change due to a flexoelectric phenomenon becomes smaller so that a user may not recognize it.

Figure 10:
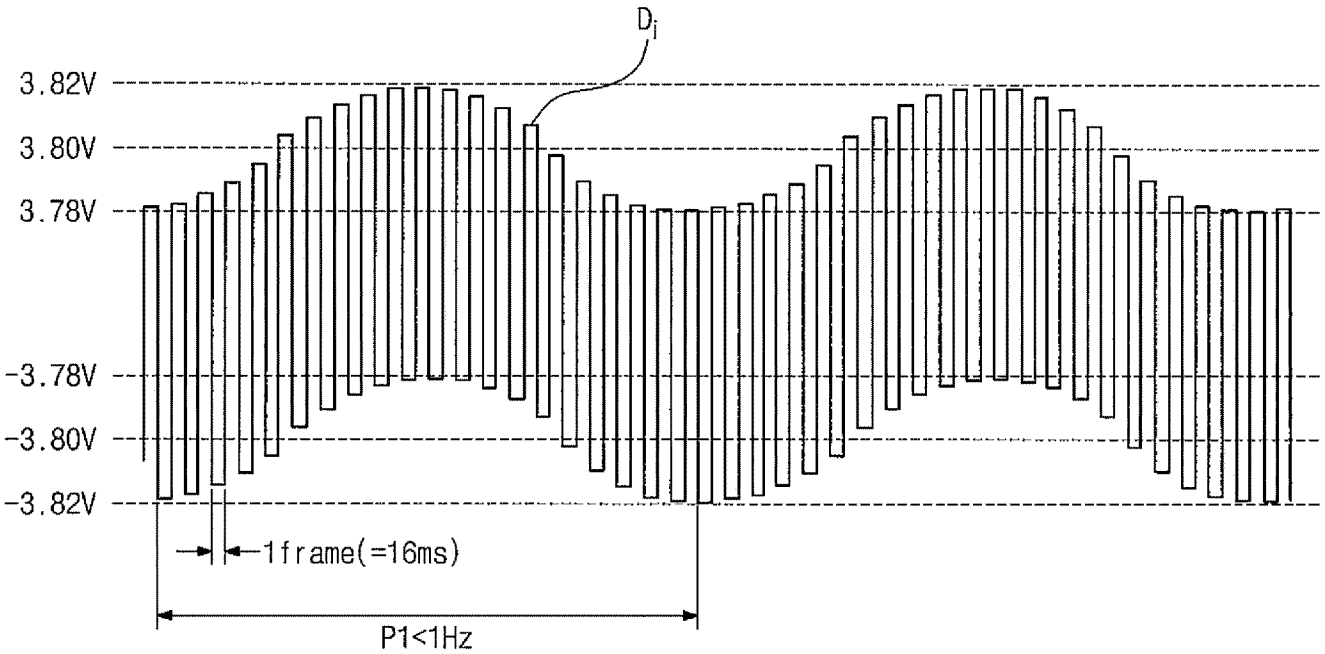
FIG. 10 is a view illustrating a data signal change provided to a predetermined data line of a display panel shown in FIG. 1.

FIG. 10 is a view illustrating a data signal change provided to a predetermined data line of the display panel shown in FIG. 1.

Referring to FIG. 10, when it is assumed that a data signal Dj provided to a jth data line DLj is fixed to the maximum grayscale corresponding to a white grayscale, and is maintained for a long time, the data signal Dj is inverted into a positive grayscale and a negative grayscale at each frame. Additionally, the data signal Dj swings at each predetermined period P1 between an upper voltage level V_PU and a lower voltage level V_NL. When a change period P1 of the data signal Dj is set to a sufficiently low value (for example, less than about 1 second), and when a voltage level change width is set to be small at each frame, a user might not detect a brightness change due to the data signal Dj, and the flexoelectric effect may be reduced or minimized.

Figure 11:
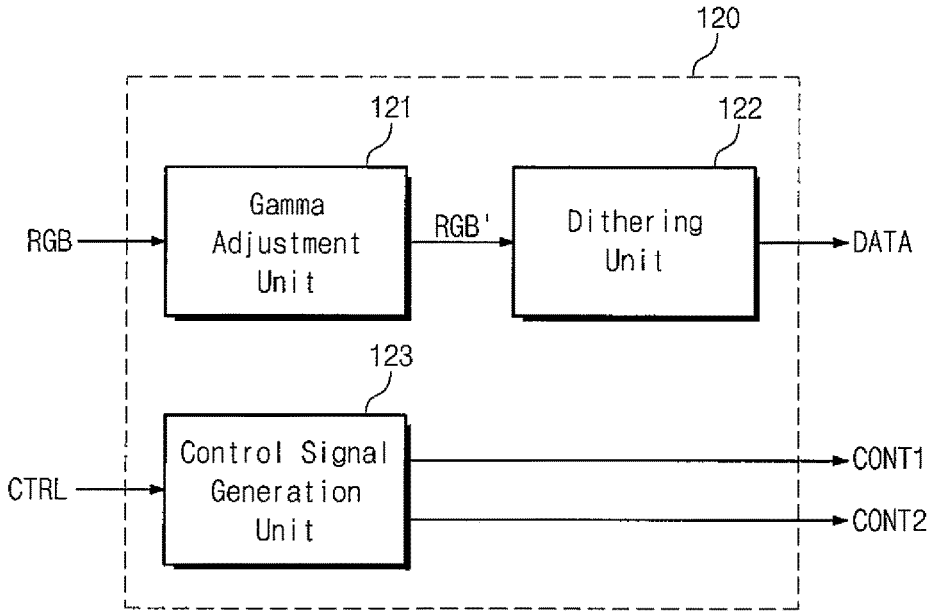
FIG. 11 is a view illustrating a configuration of a timing controller shown in FIG. 1.

FIG. 11 is a view illustrating a configuration of the timing controller shown in FIG. 1.

Referring to FIG. 11, a timing controller 120 includes a gamma adjustment unit 121, a dithering unit 122, and a control signal generation unit 123.

The gamma adjustment unit 121 receives an image signal RGB. The gamma adjustment unit 121 outputs a gamma data signal RGB' that is adjusted to change gamma characteristics of the image signal RGB to be changed in a given period. The dithering unit 122 outputs a data signal DATA by dithering the gamma data signal RGB'.

The control signal generation unit 123 outputs a first control signal CONT1 and a second control signal CONT2 in response to a control signal CTRL. The first control signal CONT1 is provided to the data driving circuit 140 of FIG. 1, and the second control signal CONT2 is provided to the gate driving circuit 130 of FIG. 1.

Figure 12:
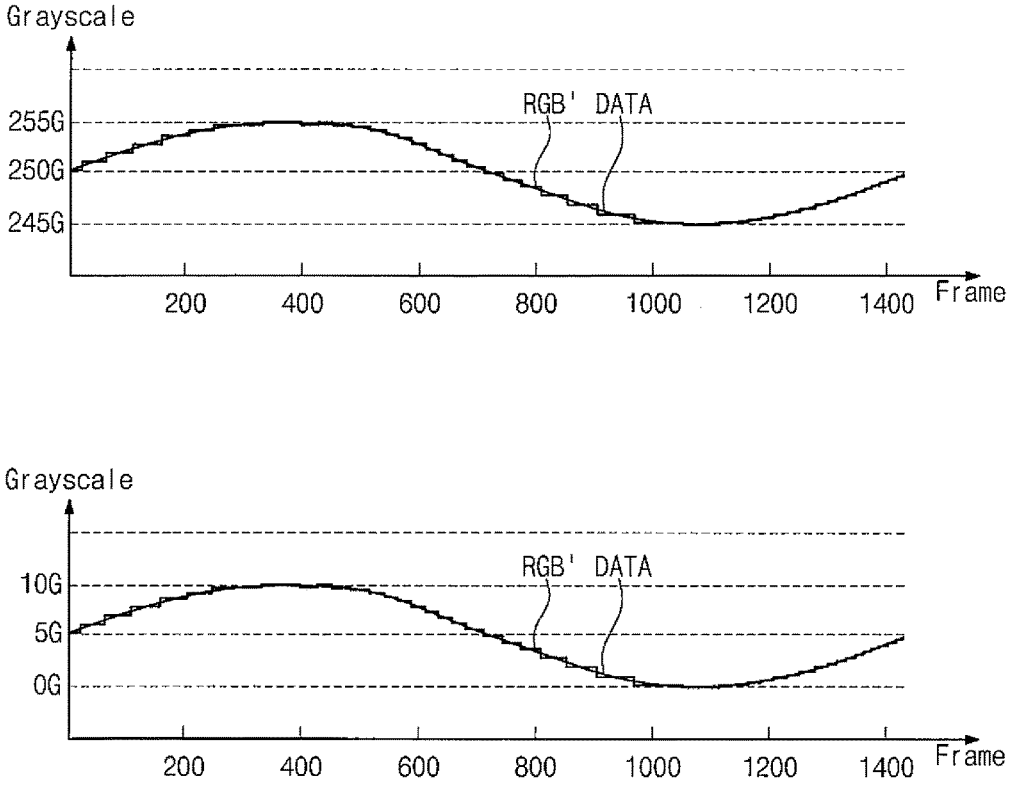
FIG. 12 is a view illustrating a gamma adjustment operation of a timing controller shown in FIG. 11.

FIG. 12 is a view illustrating a gamma adjustment operation of the timing controller shown in FIG. 11.

Referring to FIGS. 11 and 12, the gamma adjustment unit 121 outputs a gamma data signal RGB' that is adjusted to change gamma characteristics of the image signal RGB to be changed in a given period. For example, when an image signal RGB corresponding to a 250 grayscale 250G is inputted, the gamma adjustment unit 121 outputs a gamma data signal RGB' that swings periodically between a 245 grayscale 245G and a 255 grayscale 255G. A change period of the gamma data signal RGB' may be a sufficient amount of time so that a user may not recognize a grayscale change.

For example, when an image signal RGB corresponding to a 5 grayscale 5G is inputted, the gamma adjustment unit 121 outputs a gamma data signal RGB' that swings periodically between a 0 grayscale 0G and a 10 grayscale 10G.

In the example shown in FIG. 12, the gamma data signal RGB' swings between a grayscale+5 and the grayscale−5 based on the image signal RGB. However, a swing range of the gamma data signal RGB' may be changed in other embodiments.

The gamma adjustment unit 121 may downscale an image signal RGB having a grayscale between a 0 grayscale 0G and a 255 grayscale 255G into an image signal having a grayscale level between a 5 grayscale 5G and a 250 grayscale 250G, and may output a gamma data signal RGB'.

Because the gamma data signal RGB' is changed at a given frame, a brightness difference may be detected by a user at a timing that a grayscale level is changed. The dithering unit 122 changes the gamma data signal RGB to be in a soft curved form, and outputs a data signal DATA, thereby preventing a user from detecting a brightness difference.

When the timing controller 120 shown in FIG. 1 includes the gamma adjustment unit 121 and the dithering unit 122 shown in FIG. 11, the voltage generator 150 may generate first to fourth reference voltages REF_PU, REF_PL, REF_NU, and REF_NL having a fixed voltage level.

A display device having such a configuration generates gamma voltages based on a plurality of reference voltages but changes a voltage level of a plurality of reference voltages so that a residual DC voltage accumulated at a pixel electrode may be distributed. Because intensive accumulation of a residual DC voltage at a specific position of a pixel electrode is prevented, a residual image may be removed. Therefore, display quality may be improved.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display device comprising:

a display panel comprising a plurality of pixels respectively connected to a plurality of gate lines and to a plurality of data lines;

a gate driving circuit configured to drive the plurality of gate lines;

a data driving circuit configured to drive the plurality of data lines;

a timing controller configured to provide a data signal to the data driving circuit, configured to control the gate driving circuit, and configured to output a voltage control signal; and a voltage generator configured to generate first to fourth reference voltages in response to the voltage control signal, wherein the data driving circuit is further configured to convert the data signal into a grayscale voltage based on the first to fourth reference voltages, wherein, during operation, a voltage level of each of the first and second reference voltages is changed periodically within a first swing range, and is changed in a stepwise manner according to a sine waveform, wherein, during operation, a voltage level of each of the third and fourth reference voltages is changed periodically within a second swing range, and is changed in a stepwise manner according to a sine waveform, wherein the first swing range having a voltage level that is higher than a common voltage and the second swing range having a voltage level that is lower than a common voltage.

2. The display device of claim 1, wherein the data driving circuit comprises:

a gamma voltage generator configured to generate a plurality of gamma voltages based on the first to fourth reference voltages; and a data driver configured to select a gamma voltage of the plurality of gamma voltages corresponding to the data signal as the grayscale voltage, and configured to drive the plurality of data lines by using the grayscale voltage.

3. The display device of claim 2, wherein the gamma voltage generator comprises:

a positive reference voltage generation unit configured to generate a plurality of positive reference voltages based on the first and second reference voltages; and a positive gamma voltage generation unit configured to generate a plurality of positive gamma voltages based on the plurality of positive reference voltages.

4. The display device of claim 2, wherein the gamma voltage generator comprises:

a negative reference voltage generation unit configured to generate a plurality of negative reference voltages based on the third and fourth reference voltages; and a negative gamma voltage generation unit configured to generate a plurality of negative gamma voltages based on the plurality of negative reference voltages.

5. The display device of claim 1, wherein the voltage control signal comprises information corresponding to an upper voltage level and a lower voltage level for each of the reference voltages.

6. The display device of claim 5, wherein each of the first and second reference voltages are changed stepwise into a plurality of voltage levels between the upper voltage level and the lower voltage level.

7. The display device of claim 1, wherein the voltage control signal comprises information corresponding to a change period of each of the reference voltages.

8. The display device of claim 7, wherein the change period is less than about 1 second.

9. The display device of claim 1, wherein a voltage level of each of the first to fourth reference voltages is at a constant voltage level, and wherein the timing controller is further configured to receive an image signal, to convert the image signal into the data signal that is changed periodically within a range, and to provide the data signal to the data driving circuit.

10. The display device of claim 9, wherein the timing controller comprises:

a gamma adjustment unit configured to adjust a gamma level of the image signal, and configured to output a gamma data signal; and a dithering unit configured to dither the gamma data signal to output the data signal.

11. The display device of claim 10, wherein the gamma data signal swings periodically within a range based on the image signal.

* * * * *